United States Patent [19]

Ford

[11] 4,318,576

[45] Mar. 9, 1982

[54] CABINET ASSEMBLY

[75] Inventor: Alan A. Ford, Irvine, Calif.

[73] Assignee: Kirsch Company, Sturgis, Mich.

[21] Appl. No.: 158,747

[22] Filed: Jun. 12, 1980

[51] Int. Cl.[3] ..... A47B 43/00; A47F 3/06

[52] U.S. Cl. ..... 312/264; 312/257 SK; 312/140; 108/101

[58] Field of Search ..... 312/264, 263, 257 SK, 312/257 A, 257 SM, 140; 108/60, 91, 101, 114

[56] References Cited

U.S. PATENT DOCUMENTS

| | | | |
|---|---|---|---|
| 910,817 | 1/1909 | Himmel | 312/140 |
| 1,431,823 | 10/1922 | Leconte | 108/114 |
| 1,631,718 | 6/1927 | Campbell | 312/257 SK |
| 2,071,809 | 2/1937 | Anderson | 312/140 |
| 2,167,525 | 7/1939 | Rosendale | 312/257 SK |
| 2,443,515 | 6/1948 | Rockwell | 312/263 |
| 2,945,270 | 7/1960 | Schaefer | 312/263 |
| 3,250,582 | 5/1966 | Kassimir | 312/140 |
| 3,636,893 | 1/1972 | Lange | 108/101 |
| 3,677,416 | 7/1972 | Block et al. | 312/140 |
| 3,680,899 | 8/1972 | Newcomer | 312/263 |
| 3,831,533 | 8/1974 | Kellogg | 108/101 |
| 4,078,847 | 3/1978 | Presnick | 312/263 |

FOREIGN PATENT DOCUMENTS

| | | | |
|---|---|---|---|
| 474984 | 8/1969 | Switzerland | 312/263 |
| 819500 | 9/1959 | United Kingdom | 312/263 |
| 902819 | 8/1962 | United Kingdom | 312/264 |

*Primary Examiner*—Victor N. Sakran

*Attorney, Agent, or Firm*—Blanchard, Flynn, Thiel, Boutell & Tanis

[57] ABSTRACT

Cabinet structure, particularly of the knockdown type. There is provided structural means for cooperation with presently known easily assembled and disassembled shelving structure for converting same into an easily assembled and attractive closed cabinet. Starting with the shelving structure in unchanged condition there is provided a plurality of small clips for the reception and holding of appropriate side and door means for converting said shelving into a closed cabinet. Said clips utilize the corner posts of the shelving for properly locating same, are provided with upstanding flanges for the reception and holding of appropriate fixed panels and certain of said clips are also provided with pivot posts for the reception and pivotal support of appropriate doors and all of said clips are interlocked by, and with respect to, said panels, shelving and corner posts for holding all of said parts fixed with respect to each other with the necessity of only minor, if any, fastening means other than those already provided between the corner posts and the shelving.

4 Claims, 15 Drawing Figures

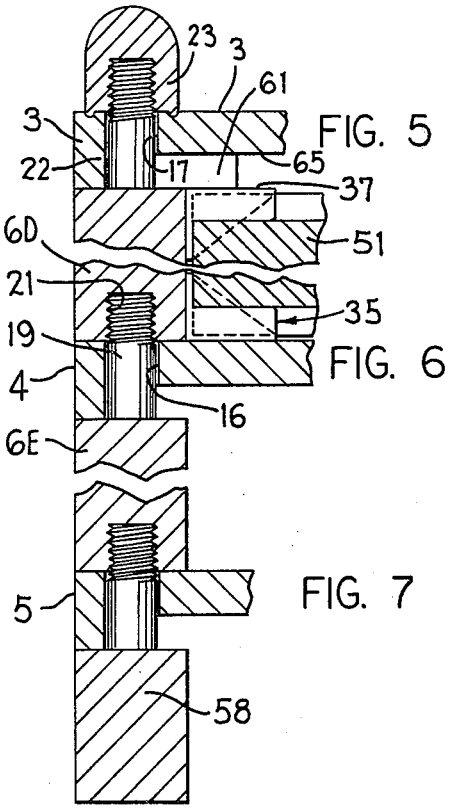
FIG. 5
FIG. 6
FIG. 7
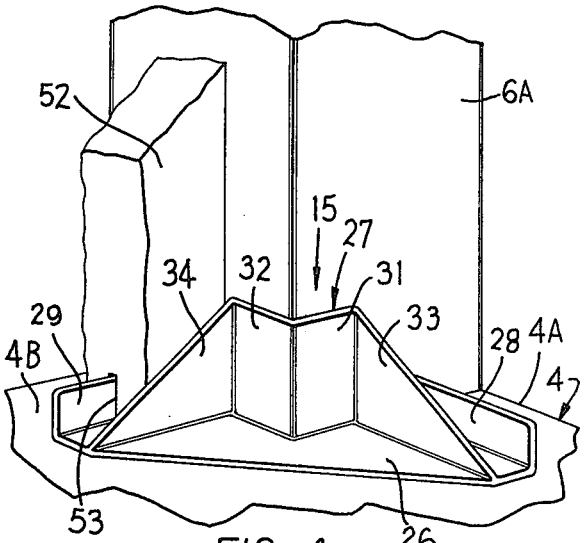
FIG. 4
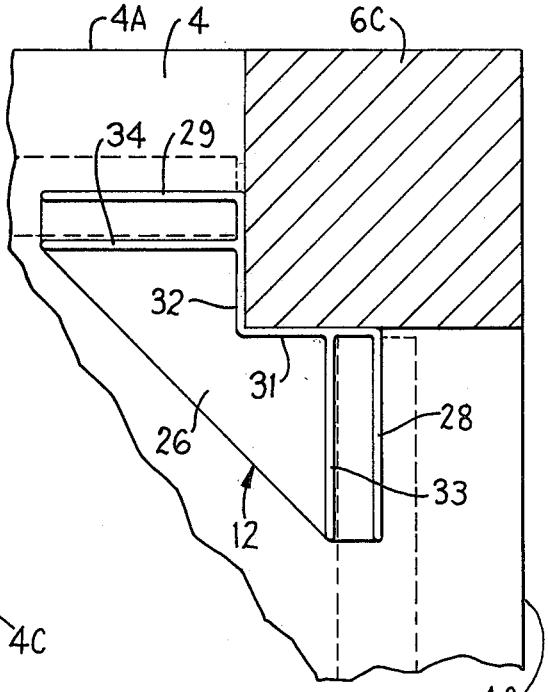
FIG. 8
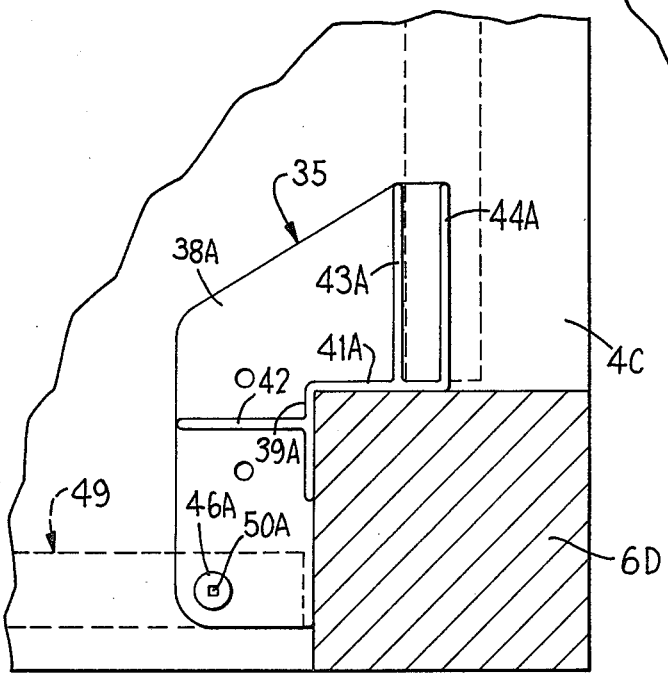
FIG. 9

CABINET ASSEMBLY

FIELD OF THE INVENTION

The invention relates to cabinet construction, particularly of the easily assembled and disassembled type and is more particularly concerned with means by which a presently known type of easily assembled and disassembled open and free-standing shelving can be converted in whole or in part as desired to a closed cabinet.

BACKGROUND OF THE INVENTION

Free-standing open shelving of the type which can be readily assembled and disassembled has been known for many years and has been offered to the market in a variety of specific forms. Examples are those shown in, among others, U.S. Pat. Nos. 1,431,823, 3,636,893 and 3,831,533. As set forth in said U.S. Pat. No. 3,831,533, this shelving can be assembled in many specific arrangements according to the use desired of them. Further, this shelving can be and has been made from a variety of materials, particularly wood or plastics, and offered both to the inexpensive and to the premium-priced markets.

In assembling such shelving, it has often been desirable to include within such a shelf unit a closed cabinet for any one of many well recognized purposes. However, the means thus far devised for this purpose have either been undesirably expensive or have required preliminary modification in the shelving structure itself. These limitations have inhibited this type of product from achieving its full market potential.

Accordingly, the objects of the invention include:

1. To provide means for converting at least a selected portion of an open shelving construction into a closed cabinet.

2. To provide means, as aforesaid, which can be applied quickly and easily without the need for tools other than simple tools, if any.

3. To provide means, as aforesaid, by which the cabinet creating means can be applied to any selected portion of such shelving without preliminary modification thereof.

4. To provide means, as aforesaid, which will require only a few relatively small and simple special components whereby such cabinet may be provided at a minimum of expense.

5. To provide means, as aforesaid, which can be made of any material compatible with the basic shelving whereby same may be easily adapted to the low-cost market or to the premium-priced market as desired.

6. To provide means, as aforesaid, which will be strong and sturdy and capable of long life without repairs or adjustments.

Other objects and purposes of the invention will be apparent to persons acquainted with structures of this general type upon reading the following disclosure and upon inspection of the accompanying drawings.

BRIEF DESCRIPTION OF THE DRAWINGS

In the drawings:

FIG. 4 is an oblique enlarged detail of another portion of FIG. 2.

FIG. 5 is a fragmentary section taken on the line V—V of FIG. 1.

FIG. 6 is a fragmentary section taken on the line VI—VI of FIG. 1.

FIG. 7 is a fragmentary section taken on the line VII—VII of FIG. 1.

FIG. 8 is a sectional view taken on line VIII—VIII of FIG. 2, same comprising in substance a top view of a mounting clip identical with the mounting clip shown obliquely in FIG. 4.

FIG. 9 is a section taken on the line IX—IX of FIG. 2, same comprising in substance a top view of a mounting clip which is a mirror image of the mounting clip shown obliquely in FIG. 3.

DETAILED DESCRIPTION

Figure 1:
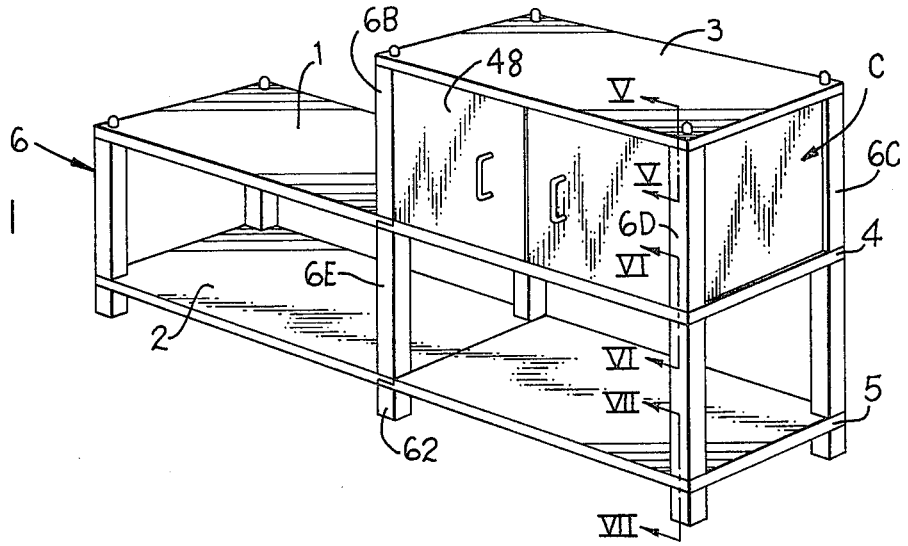
FIG. 1 is an oblique view of a shelf assembly substantially according to U.S. Pat. No. 3,831,533 with the cabinet structure of the invention applied to one shelf section therein.
Figure 2:
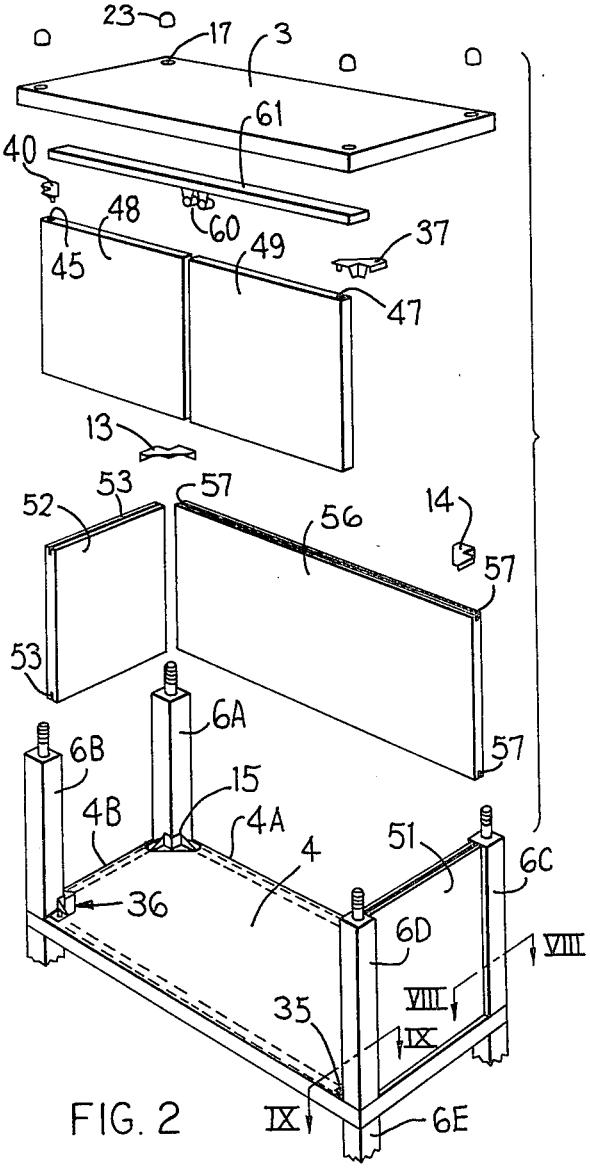
FIG. 2 is an oblique, partially exploded view of the components comprising a single shelving unit and the parts by which same are converted to a swinging door cabinet.

For the purpose of showing the environment in which the invention is used and the problem out of which it arose, attention is called first to FIG. 1 which shows a series of shelf units assembled according to the prior art, particularly for illustrative purposes, assembled according to U.S. Pat. No. 3,831,533. This assembly is represented by shelves indicated at 1–5 and same are held together in easily assembled and disassembled relationship by a plurality of posts generally indicated at 6. This specific manner of assembly between said posts and the shelves is well developed in the prior art but for example may be that specifically shown in the above-mentioned U.S. Pat. No. 3,831,533. The shelving unit as here shown, however, rather than being all open shelving as set forth in said patent includes a cabinet section C which by the means of the invention is applied to any selected portion of said shelving by simple and inexpensive means and without previous modification or other preparation of the shelving components. It is emphasized that the cabinet structure may be applied to any section of said shelving as selected by the ultimate customer at the time of assembly thereof and the particular location shown here is for illustrative purposes only.

Turning now to FIGS. 1–13 wherein there is shown one section of said shelving with the cabinet structure applied thereto, there is shown in this embodiment the shelves 3 and 4 which are spaced from and supported with respect to each other by corner posts previously identified generally by the numeral 6 but here identified individually for the purposes of further description as 6A, 6B, 6C and 6D. A hole 16 is provided through each corner of the shelf 4 and a hole 17 is provided for each corner of the shelf 3. The shelves are preferably recessed as shown on their lower sides for weight and material saving reasons. A supporting post 6E has a projecting pin 19 extending through said hole 16 and same is received into an appropriate recess 21 in the corner post 6D. By appropriate threading of said pin 19 and recess 21, the posts 6E and 6D may be firmly locked together and will lock the shelf 4 tightly therebetween. The shelf 3 may be similarly related to the upper end of the corner post 6D and locked in place if there is another shelf section positioned thereabove or if, as shown, there is no shelf section positioned thereabove the projection 22 enters into a suitably threaded finial 23 or other cap means fixed thereabove to lock the shelf 3 tightly against the post 6D in a known manner.

The remainder of the shelf structure will comprise extensions in any desired pattern of the structure thus far described as fully set forth in said U.S. Pat. No. 3,831,533 and other patents mentioned above.

Turning now to the means by which the shelf section thus far described is converted into a closed cabinet, there is provided first a plurality of corner clips now to be considered. There are only three shapes of such clips required, same being partially adaptable for right or lefthand, top or bottom use as needed. One form of said clip is shown in detail in FIGS. 4 and 8 and another form of clip is shown in detail in FIG. 3. A third form of clip is provided in mirror image to the clip of FIG. 3 as described further below and shown at 35 in FIG. 9.

Turning first to the clips shown in FIGS. 4 and 8, same will be the clips used at the back of the cabinet, namely in association with the corner posts 6A and 6C. The clip 15 adjacent corner post 6A comprises a base flange 26 having upstanding therefrom a positioning flange 27 and a pair of panel flanges 28 and 29. Said positioning flange 27 consists in this embodiment of a pair of aligning components 31 and 32 which are positioned with respect to each other to fit snugly against at least two surfaces of said corner post, here the corner post 6A. In this embodiment, since said corner post is of rectangular cross section, said aligning components 31 and 32 will be positioned at right angles with respect to each other. The positioning flange 27 further includes a buttress flange 33 extending from the free end of the aligning component 31 along said base 26 and a further buttress flange 34 extending from the free end of the aligning component 32 along said base 26. Here both of said buttress flanges are slanted downwardly as shown to save material and to improve the appearance.

The base 26 extends beyond the buttress flange 33 and turns upwardly at its edge to provide the panel flange 28. Said panel flange when said clip is in operating position will be parallel with the adjacent edge 4A of the shelf which in this case, given the square cross section of the corner post 6A, means that it will be perpendicular to the aligning component 31.

The base 26 similarly extends beyond the buttress flange 34 and terminates in an upwardly extending panel flange 29 which is parallel with the end 4B of said shelf and, in this instance, given the rectangular cross section of the corner post 6A, means that it is perpendicular to the positioning component 32.

The clip 12 (at the bottom of post 6C) and the clips 13 and 14 (at the tops of posts 6A and 6C, respectively) are all identical with the clip 15 just described excepting that same are rotated and/or inverted as needed in order to bear the same relationship to their respectively adjacent posts as that borne by the clip 15 to the post 6A. For example, it will be seen in FIG. 8 that the clip 12, identical to the clip 15, here has the panel flange 28 facing and parallel with the end 4C of the shelf 4 and the panel flange 29 facing and parallel with the side 4A of said shelf. In view of the foregoing, the inverting and otherwise appropriate positioning of the clips 13 and 14 at the upper ends of the posts 6A and 6C will be obvious.

For reasons appearing hereinafter, the panel flanges 28 of clip 15 and 29 of clip 12 together with the corresponding panel flanges on clips 13 and 14 will all define a common plane.

Figure 3:
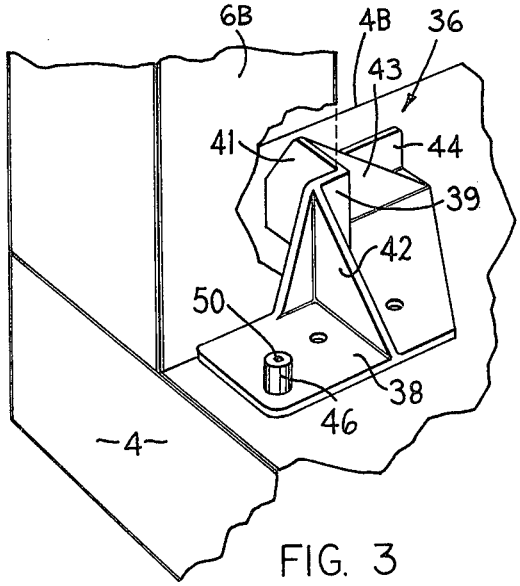
FIG. 3 is an oblique enlarged detail of a portion of FIG. 2.
Figure 10:
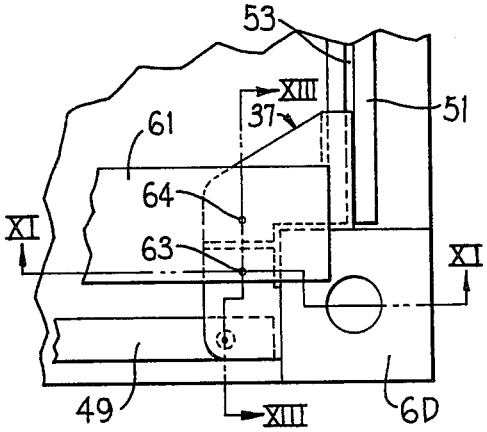
FIG. 10 is a top view of the same corner as shown in FIG. 9 with shelf 3 removed in order better to show the parts lying thereunder.
Figure 11:
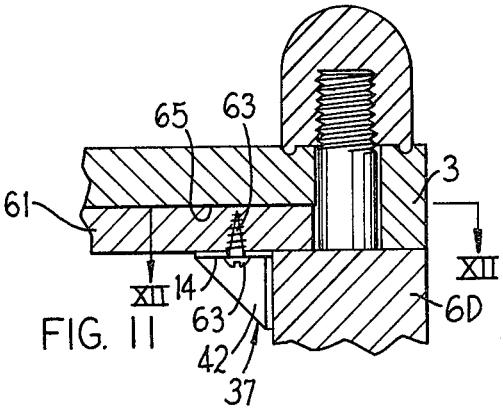
FIG. 11 is a section taken on the line XI—XI of FIG. 10.
Figure 12:
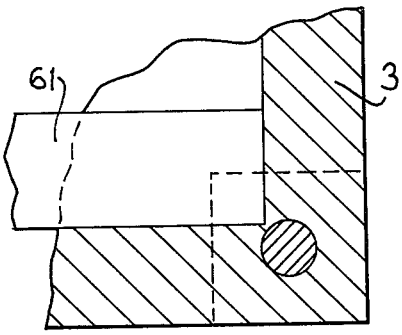
FIG. 12 is a section taken on the line XII—XII of FIG. 11.
Figure 13:
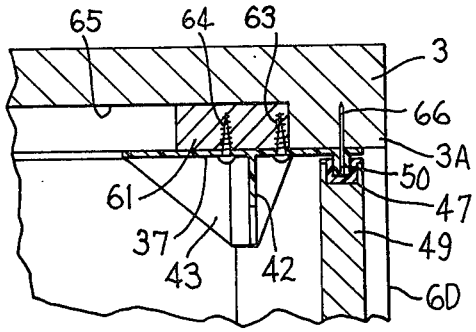
FIG. 13 is a section taken on the line XIII—XIII of FIG. 10.

Turning now to the clip 36 appearing at the front (door) side of the cabinet, same is illustrated in detail primarily in FIG. 3, with clip 35 best shown in FIG. 9 showing a mirror image thereof. The parts of FIG. 9 corresponding to the parts of FIG. 8 are designated by corresponding numbers with "A" added thereto. Similarly to the clip 15, the clip 36 has a base plate 38 having upright positioning flanges 39 and 41, same being arranged to fit snugly against the adjacent corner post 6B. In this case, since said corner post is of rectangular cross section, said plates 39 and 41 are perpendicular with respect to each other to embrace a corner of said corner post 6B. Said upstanding plates are provided with buttress flanges 42 and 43 for stiffening of same, said buttress flanges preferably, as the buttress flanges 33 and 34, slanting downwardly as shown both for saving of material and to improve their appearance. The base plate 38 extends past the buttress flange 43 and has at its edge an upstanding panel flange 44 which when said clip is in operative position is aligned parallel with the adjacent end 4B of the shelf 4 which means, with the corner post 6B of rectangular shape as shown, that said panel flange 44 is perpendicular to the positioning flange 41. Thus far, the clip 36 is essentially identical with the clip 15 in a manner which will be obvious without detailed comparison. However, instead of there being a second upstanding panel flange corresponding to panel flange 29 of the clip 15, there is an upstanding pivot post 46 of circular cross section to function as a pivot for a door 48. Preferably said pivot post has a hole 50 therethrough for purposes described later.

A clip 37 is identical with the clip 36 but is inverted for use at the upper end of the post 6D. The further clip 35 which is a mirror image of the clip 36 is used at the bottom of the corner post 6D and provides with post 6D a mirror image of the relationship of clip 36 with the post 6B. Another clip 40 identical with clip 35 is inverted for use at the top of the post 6B.

The mounting and spacing of said clips will be such that the pivot post of clip 36 will be coaxial with the pivot post of clip 40 and the pivot post of clip 35 will be coaxial with the pivot post of clip 37.

Further the mounting and spacing of said clips will be such that the panel flange 29 of clip 15 and the panel flange 44 of clip 36 together with the corresponding panel flanges on the clips 13 and 40, respectively, will all define a common plane. Likewise, the panel flanges of the clips 12, 35, 14 and 37 will similarly all define a common plane.

The doors 48 and 49 are each provided with suitable recesses 45 and 47 of which those at the top of each thereof will receive the posts corresponding to the post 46 in each of the clips 40 and 37 and recesses (not shown) at the bottom of each of said doors will receive the pivot post 46 and the corresponding post 46A of the clip 35.

End panels 51 and 52 are provided with slots 53 in the tops and bottoms of each thereof. Same are installed by positioning panel 52 between the corner posts 6B and 6A at the end of the shelf 4 and placing the lowermost slot 53 of the panel 52 over the panel flanges 44 and 29. The panel 51 is installed by placing it between the corner posts 6D and 6C and receiving into its lowermost slot 53 the panel flanges of clips 35 and 12 corresponding to panel flanges 44 and 29 of the clips 36 and 15. The rearward panel 56 has similar top and bottom slots 57 and it is installed by sliding same between the corner posts 6A and 6C and receiving into the bottom slot 57 the panel flange 28 of the clip 15 and the panel flange 29 of the clip 12.

While said clips may be, if desired, rigidly fixed as by screwing to the shelf 4, because of the manner in which same are positioned between the end panels, the back panel and the corner posts, they will be ridigly held in position anyway and screwing of same to said shelf is unnecessary.

The corner clips 13 and 14 at the upper ends of the corner posts 6A and 6C are installed into the upper grooves of the end and rear panels and against said corner posts in a manner corresponding to that already described with respect to the clips 15 and 12.

Turning now to the clips 40 and 37 at the upper ends of the corner posts 6B and 6D, there is provided a stop member 61 extending across the front of the cabinet above the doors 48 and 49. Said stop member 61 is fixed as by screws 63 and 64 to the upper sides of the clips 40 and 37 and is received into the recess 65 of the upper shelf 3 when the parts are assembled (see especially FIGS. 2, 5, 11 and 13). The respective flanges 44 of said last-named clips are received into the upper grooves 53 of said end panels and their pivot posts vertically aligned respectively with the pivot posts 46 and 46A of the clips 36 and 35.

A fastener 66, either a screw or a nail as desired, is operably passed through an appropriate part of said plate 37, here through the hole 50 in the pivot post as shown, to enter into the peripheral flange 3A of the shelf 3 in order further to hold the clip 37 firmly in place with respect to said shelf 3. The clips 35, 36 and 40 will preferably be similarly fixed to the shelves respectively adjacent each thereof in order to insure firm and solid support for the pivotally mounted doors 48 and 49.

The doors 48 and 49 are installed by placing their respective lower pivot openings onto the posts 46 and 46A of clips 36 and 35 and then placing the respective pivot posts of the upper corner clips into the upper openings as the openings 45 and 47 of said doors. Substantially simultaneously with such placing of said pivot posts, the panel flanges of said clips 40 and 37 will be inserted into the upper grooves 53 of the respective end panels 52 and 51.

If desired, suitable holders, such as magnetic holders 60 may be positioned below the stop member 61 for appropriately engaging and holding the doors 48 and 49 in closed position. When the shelf 3 is in position, all of the clips adjacent the upper ends of said corner posts will be held firmly in place and the end panels, back panels and the doors likewise firmly held in position.

It will be apparent that with extreme flexibility of the described construction, any number of sections of the multiple shelving above mentioned may be fitted with the described components for converting same into a closed cabinet or, if preferred, a single section of such shelving may be utilized without connection to other such sections and a single cabinet constructed therewith. In such case, the lower members 6E will be replaced by the short members 62 for engaging the floor or othr supporting surface.

Figure 14:
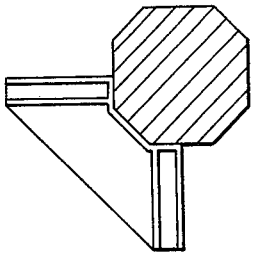
FIG. 14 is a view similar to FIG. 8 showing a modification.
Figure 15:
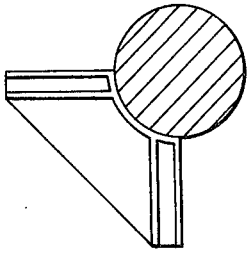
FIG. 15 is a view similar to FIG. 8 showing a further modification.

While the corner posts in the described embodiment have been shown as of rectangular (including square) cross section, same may if desired be of other cross sections, such as octagonal and/or circular and if so the corner clips will be preferably, though not necessarily, modified appropriately as shown in FIGS. 14 and 15.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. For use with a free-standing shelving unit which includes at least a pair of parallel horizontal shelves and at least four vertical corner posts positioned between said shelves for holding same fixedly with respect to each other in vertically spaced relationship, means for converting at least part of the shelving unit into a closed cabinet, comprising:

a pair of end panels, a back panel and a pair of doors sized to extend vertically between said shelves and horizontally between pairs of said corner posts for defining a closed cabinet which utilizes said shelves as the top and bottom walls thereof, said end and back panels having grooves which project inwardly of the panels from the top and bottom edges thereof; and a plurality of one-piece corner clips for embracing said corner posts adjacent the lower and upper ends of each post and for also supportingly engaging said panels and doors for defining the closed cabinet;

said plurality of corner clips including four rear corner clips and four front corner clips, one of the rear corner clips being positioned adjacent the upper and lower ends of each rear corner post directly adjacent the respective upper and lower shelves, and one of the front corner posts being positioned adjacent the upper and lower ends of each front corner post directly adjacent the respective upper and lower shelves;

each said rear corner clip including (1) a substantially horizontal platelike base member which overlies the lower or upper surface of the respective shelf, (2) a first panel-engaging flange fixed to said base member adjacent an outer edge thereof and projecting vertically therefrom, (3) a second panel-engaging flange fixed to said base member adjacent an outer edge thereof and projecting vertically therefrom, said first and second panel-engaging flanges being substantially perpendicular to one another and engageable within the grooves formed in the edges of the adjacent back and end panels, and (4) a positioning flange fixed to said base member adjacent an outer edge thereof and projecting vertically therefrom, said positioning flange extending horizontally between and being fixedly connected to the adjacent ends of said panel-engaging flanges, said positioning flange having a contoured outer surface which defines a substantially concave recess which faces outwardly so that said positioning flange fits snugly against and partially embraces the adjacent rear corner post;

each said front corner clip including (1) a substantially horizontal platelike base member which overlies the lower or upper surface of the respective shelf, (2) a panel-engaging flange fixed to said base member adjacent an outer edge thereof and projecting vertically therefrom, said panel-engaging flange being engageable within the groove formed in the edge of the adjacent end panel, (3) a positioning flange fixed to said base member adjacent an outer edge thereof and projecting vertically therefrom, said positioning flange being fixed to an adjacent edge of said panel-engaging flange so that the latter projects in transverse relationship to the positioning flange, said positioning flange having a contoured outer surface which defines a concave recess so that the positioning flange fits snugly against and partially embraces the adjacent front corner post, and (4) a pivot post fixed to said base member and projecting vertically therefrom in the same direction as said panel-engaging flange for defining a vertical hinge axis for one of the doors, the corner post being spaced horizontally from the positioning flange and positioned inwardly from and forwardly of the panel-engaging flange, two said pivot posts as defined on the upper and lower front corner clips as disposed adjacent one front corner post being aligned on a common axis, and each door having axially aligned recesses at their upper and lower edges for receiving said respective pair of aligned pivot posts for holding the respective door in pivotal opening and closing relationship with respect to said shelves;

said front and rear corner clips all being disposed in their entirety within the closed cabinet defined by said panels, doors, posts and shelves.

2. A structure according to claim 1, wherein each said rear corner clip includes first and second buttress flanges fixed to and projecting vertically from said base member, said first and second buttress flanges having the edges thereof integrally joined to said positioning flange, said first and second buttress flanges being positioned in parallel but spaced relationship from the respective first and second panel-engaging flanges so that the buttress flanges effectively overlie and are positioned closely adjacent the inner surfaces of the respective panels; and wherein each said front corner clip also includes first and second buttress flanges which are fixed to and project vertically from the respective base member, said first and second buttress flanges being substantially perpendicular to one another and having their inner edges fixedly and integrally connected to said positioning flange, said first buttress flange being spaced inwardly from and disposed parallel with said panel-engaging flange so that the buttress flange is positioned adjacent and effectively overlies the inner surface of the respective end panel, said second buttress flange being positioned inwardly from the pivot post.

3. A structure according to claim 1 or claim 2, wherein the positioning flange includes first and second planar portions which project vertically from the base member and extend in substantially perpendicular relationship with one another, said planar portions as associated with each rear corner clip having one of said panel-engaging flanges fixed thereto and projecting sidewardly therefrom in substantially perpendicular relationship, one of the planar portions associated with the front corner clips having the panel-engaging flange fixed thereto and projecting sidewardly therefrom in perpendicular relationship, the planar portions of each clip being disposed in abutting engagement with perpendicular planar exterior surfaces as formed on the respective corner post.

4. A structure according to claim 1 or claim 2, wherein the positioning flange has a horizontal cross section which is of an L-shaped configuration and is defined by first and second planar leg portions which are perpendicular with respect to one another and are disposed in abutting and embracing engagement with perpendicular planar exterior surfaces formed on the respective corner post, and said first and second panel-engaging flanges being respectively fixedly connected to the outer side edges of said first and second leg portions and projecting outwardly therefrom in perpendicular relationship therewith, said flanges and leg portions cooperating to define a substantially W-shaped configuration when viewed in horizontal cross section.

* * * * *